US007290537B2

(12) United States Patent
Yeh

(10) Patent No.: US 7,290,537 B2
(45) Date of Patent: Nov. 6, 2007

(54) PAINTBALL GUN

(75) Inventor: Hsin-Cheng Yeh, Yung Kang (TW)

(73) Assignee: Sunworld Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 11/653,207

(22) Filed: Jan. 16, 2007

(65) Prior Publication Data

US 2007/0113835 A1 May 24, 2007

Related U.S. Application Data

(63) Continuation-in-part of application No. 11/028,638, filed on Jan. 5, 2005, now abandoned.

(51) Int. Cl.
*F41B 11/00* (2006.01)

(52) U.S. Cl. ..... 124/71

(58) Field of Classification Search ..... 124/71–77
See application file for complete search history.

(56) References Cited

U.S. PATENT DOCUMENTS 4,936,282 A * 6/1990 Dobbins et al. ..... 124/74
5,078,118 A * 1/1992 Perrone ..... 124/74
5,257,614 A * 11/1993 Sullivan ..... 124/73
5,280,778 A * 1/1994 Kotsiopoulos ..... 124/73
5,613,483 A * 3/1997 Lukas et al. ..... 124/73
5,769,066 A * 6/1998 Schneider ..... 124/75
6,003,504 A * 12/1999 Rice et al. ..... 124/73
6,142,136 A * 11/2000 Velasco ..... 124/71
6,470,872 B1 * 10/2002 Tiberius et al. ..... 124/74
2005/0115554 A1 * 6/2005 Jones ..... 124/74
2006/0027221 A1 * 2/2006 Farrell ..... 124/31
2007/0163561 A1 * 7/2007 Gan ..... 124/72

* cited by examiner

*Primary Examiner*—Troy Chambers
(74) *Attorney, Agent, or Firm*—Rosenberg, Klein & Lee

(57) ABSTRACT

A paintball gun utilizes pressurized air to fire a paintball to avoid using a spool protruding from a barrel to fire the paintball which may pinch the user's finger, accidentally. The paintball gun also uses a low pressure regulator to seal a port of the barrel to block pressurized air from entering into the barrel to prevent triggering the gun and damaging others.

1 Claim, 6 Drawing Sheets

PAINTBALL GUN

This application is a continuation in part of my application filed Jan. 5, 2005, Ser. No. 11/028,638 now abandoned.

BACKGROUND OF THE INVENTION

1. Field of the Invention

The present invention relates to a paintball gun, and more particularly to one that applies pressurized air to directly fire a paintball, having the pressurized air passing through a spool, and to one that has a port blocked by turning a low pressure regulator to avoid hurting people by accidentally pulling a trigger.

2. Description of the Prior Art

Survival game in jungle is one of the popular sports around the world. In the game, a paintball gun is a primary weapon to be used for its safety consideration. To mitigate the risk of using paintball gun, a flask filled with pressurized air is essentially used as the power to shoot the paintball gun. As illustrated in FIG. 6 of the accompanying drawings, a barrel (A1) of a paintball gun (A) is formed with a paintball drop hole (A2) for a paintball (B) to drop therefrom into the barrel (A1) to be ready to shoot. Upon the trigger (A3) is pulled, a hammer (A4) brings a spool (A5) to strike the paintball (B) to fire.

However, when shooting the paintball (B), the speed starts from zero to fast speed instantly, which may cause deviation of the paintball (B).

Furthermore, the barrel (A1) has a trough (A6) at the endmost for a linking rod (A7) provided between the hammer (A4) and the spool (A5) to slide along. The moving speed of the linking rod (A7) is relative fast, which may pinch the user's finger or cause the user to trigger the paintball, accidentally.

SUMMARY OF THE INVENTION

It is the primary object of the present invention to provide a paintball gun, which utilizes high pressurized air to fire a paintball. The present invention comprises a spool disposed in a barrel. The barrel comprises a sleeve having an opening at a front end thereof. A spring is provided between the piston and the sleeve. A piston is provided in the sleeve to block the opening. Each of both the sleeve and the piston comprises a through hole penetrating outside. A through channel is disposed a rear section of the spool. A low-pressure regulator is provided in an air storage chamber. The low pressure regulator is provided with a block. When the trigger is pulled, low pressure air enters the through channel to push the piston and to advance the paintball, while pressurized air passes from the air storage chamber in sequence through a port and the through holes of the sleeve and the piston to fire the paintball. By having the pressurized air to directly fire the paintball, there would be no fast move by the spool protruding out of the barrel, thus there is no chance that the hand of the user to get hurt. When the low-pressure regulator is turned to block the port, it stops the pressurized air in the air storage chamber from entering into the barrel, thus to prevent accidentally pulling the trigger to hurt somebody.

DETAILED DESCRIPTION OF THE PREFERRED EMBODIMENT

Figure 1:
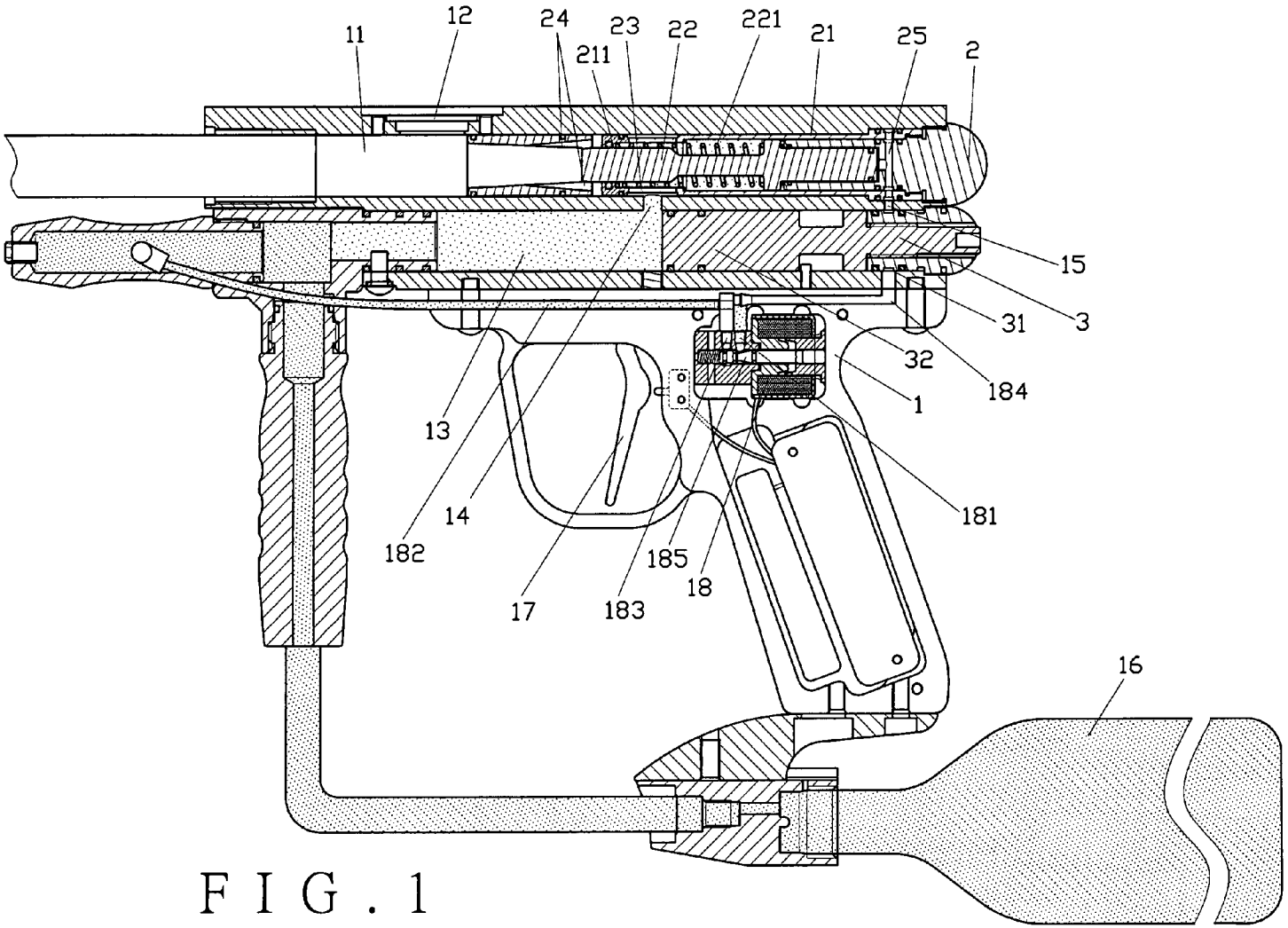
FIG. 1 is a cross-sectional view of a preferred embodiment of the present invention.
Figure 2:
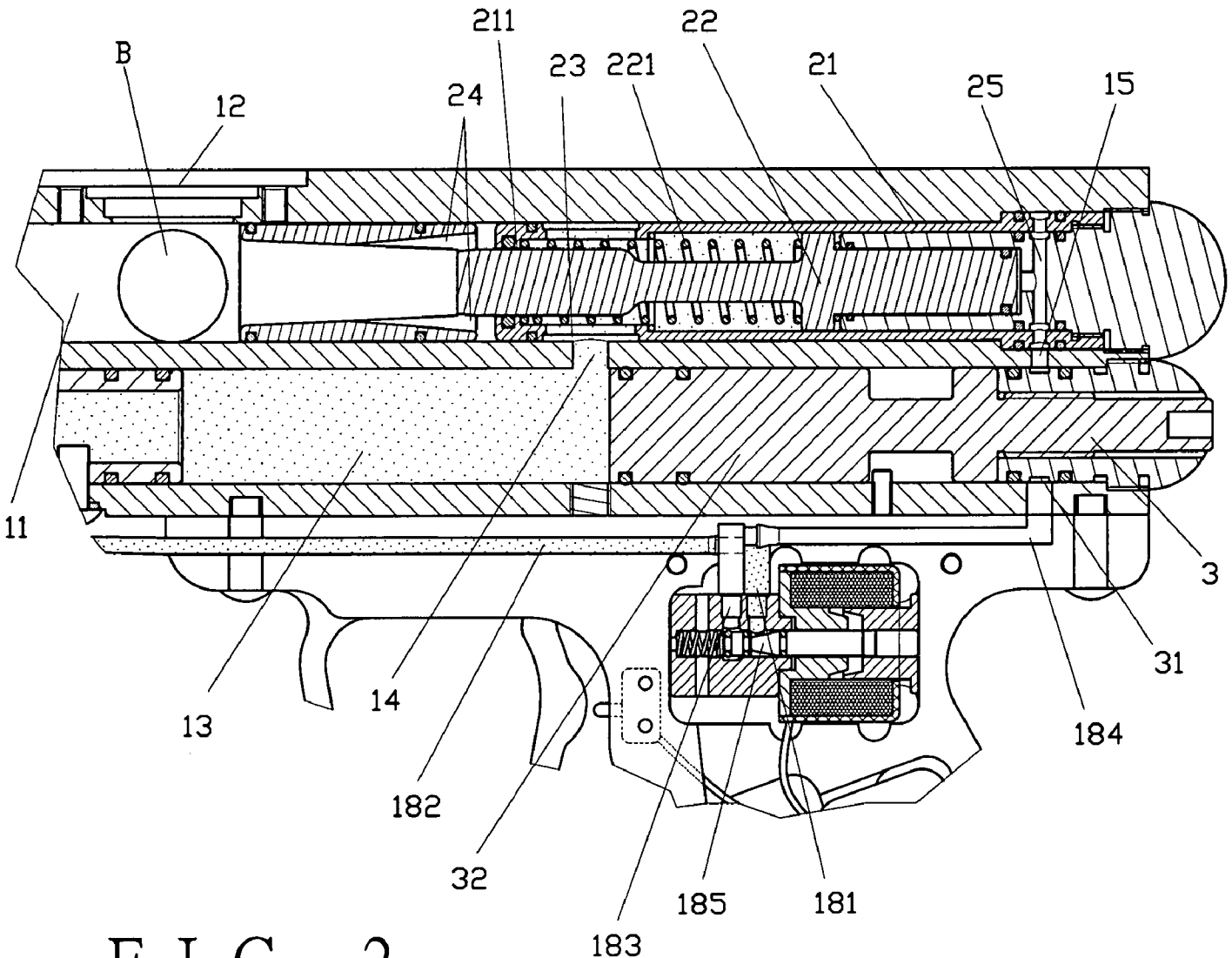
FIG. 2 is a cross-sectional view showing that a paintball is loaded into the preferred embodiment of the present invention.

As shown in FIGS. 1 and 2, a preferred embodiment of the present invention comprises a frame (1), a spool (2) and a low pressure regulator (3).

The frame (1) comprises a barrel (11) therein. A paintball drop hole (12) is disposed on the barrel (11), and an air storage chamber (13) is provided underneath the barrel (11). A port (14) is disposed at a front section between the air storage chamber (13) and the barrel (11), and a key hole (15) is disposed at a rear section between the air storage chamber (13) and the barrel (11). The front end of the air storage chamber (13) is connected to a high-pressure flask (16) to input high-pressure air into the air storage chamber (13). The frame (1) further comprises a trigger (17) and a three-way valve (18). The three-way valve (18) is controlled by the trigger (17) to activate. The three-way valve (18) comprises an air inlet hole (181) interconnecting with an air inlet way (182), an air outlet hole (183) interconnecting with an air outlet way (184) for low-pressure air to pass through, and a rod (185) to control the passage between the an air inlet hole (181) and the air outlet hole (183).

The spool (2) is disposed in the barrel (11). The spool (2) comprises a sleeve (21) having an opening (211) at a front end thereof. A piston (22) is provided in the sleeve (21) and is adapted to block the opening (211) of the sleeve (21). A spring (221) is provided between the piston (22) and the sleeve (21). A through hole (23) is disposed at the front section of the sleeve (21) to penetrate its outer edge, and another through hole (24) is disposed at the front section of the piston (22) to penetrate its outer edge. A through channel (25) is formed at the rear section of the spool (2).

The low pressure regulator (3) is threaded into the rear end of the air storage chamber (13). Both the low pressure regulator (3) and the air storage chamber (13) are formed with threads for threaded connection. The low pressure regulator (3) comprises a groove (31) on its circumference that interconnects with the through channel (25) and the air outlet way (184). The front end of the low pressure regulator (3) has a block (32) thereon.

Figure 3:
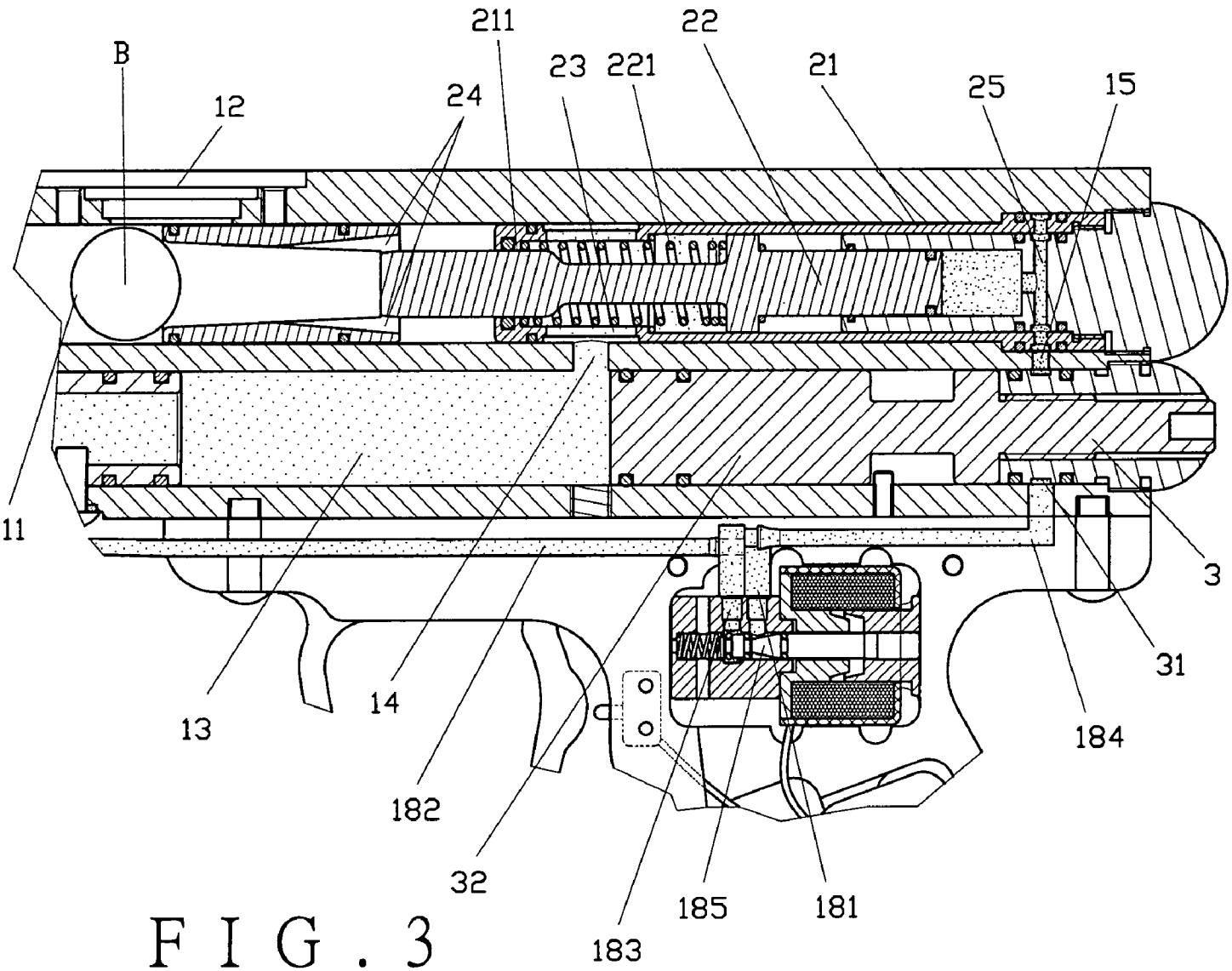
FIG. 3 is a cross-sectional view showing that low pressure air pushes a piston to advance the paintball of the preferred embodiment of the present invention.
Figure 4:
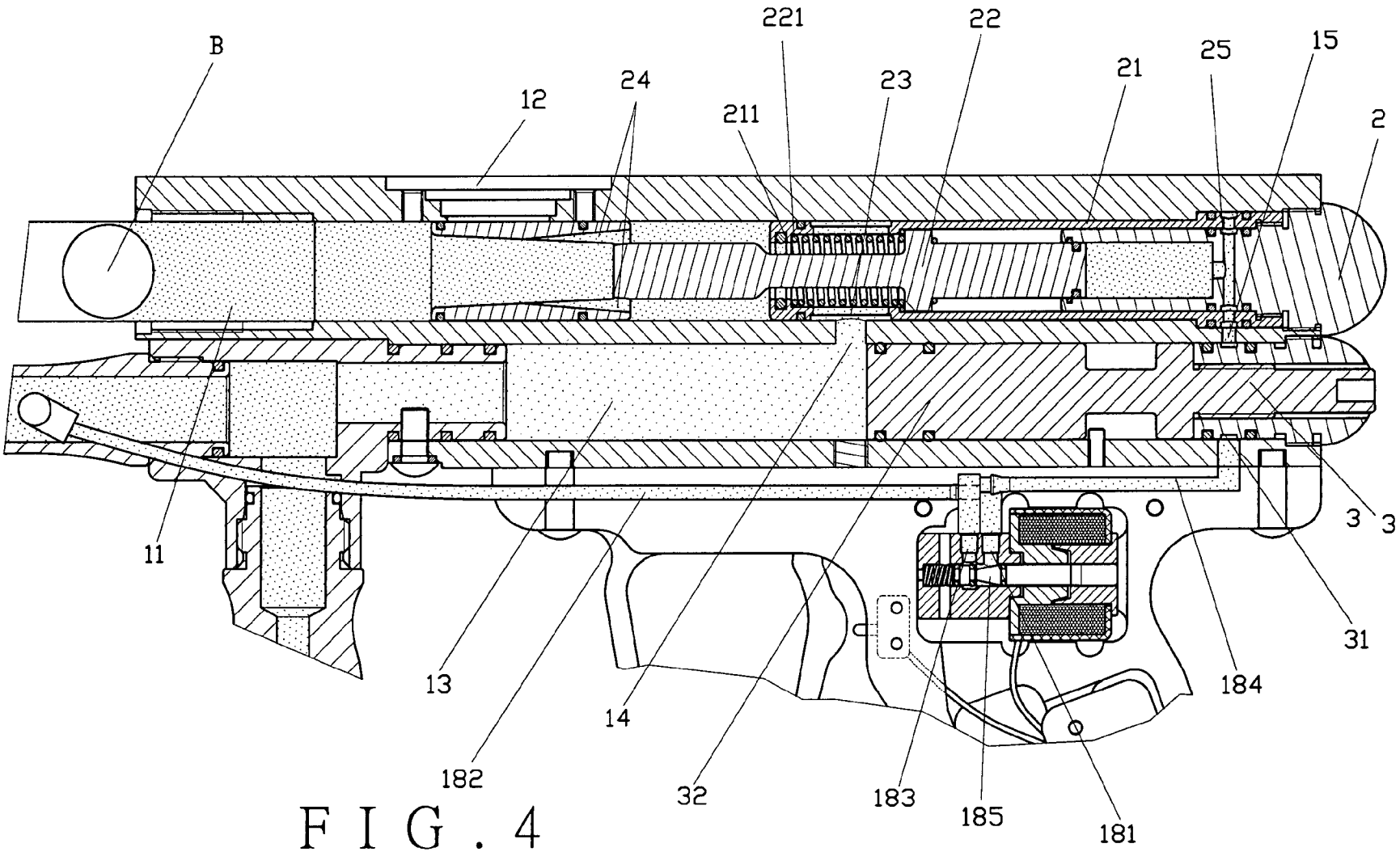
FIG. 4 is a cross-sectional view showing that high pressure air fires the paintball of the preferred embodiment of the present invention.

To operate the present invention, as shown in FIG. 2, pressurized air stored in the air flask (16) fills up the air storage chamber (13) and enters into the sleeve (21) of the spool (2) through the port (14). Due to the opening (211) of the sleeve (21) blocked by the piston (22), the pressurized air continues gathering in the spool (2). As shown in FIG. 3, upon a paintball (B) drops into the front end of the barrel (11), the user may pull the trigger (17) which drives the rod (185) of the three-way valve (18) to move forward and then opens the blockage between the air inlet hole (181) and the air outlet hole (183), allowing the low pressure air to pass through the air inlet way (182), the air inlet hole (181), the air inlet hole (183), the air outlet way (184), the groove (31) of the low pressure regulator (3), and the key hole (15) into the through channel (25) of the spool (2). The air in the through channel (25) pushes the piston (22) to slide along the sleeve (21) forward and compresses the spring (221). When the piston (22) is moving forward, the paintball (B) will be pushed to the triggering position, and the opening (211) is cleared from blocking, as shown in FIG. 4. The high pressurized air accumulating in the spool (2) at this time will be discharged at a high speed from the opening (211) and spurred out of the through hole (24) of the piston (22) to fire the paintball (B). After the paintball (B) is shot, the spring (221) urges the piston (22) to return to its original position to block the opening (211) again for next movement.

Figure 5:
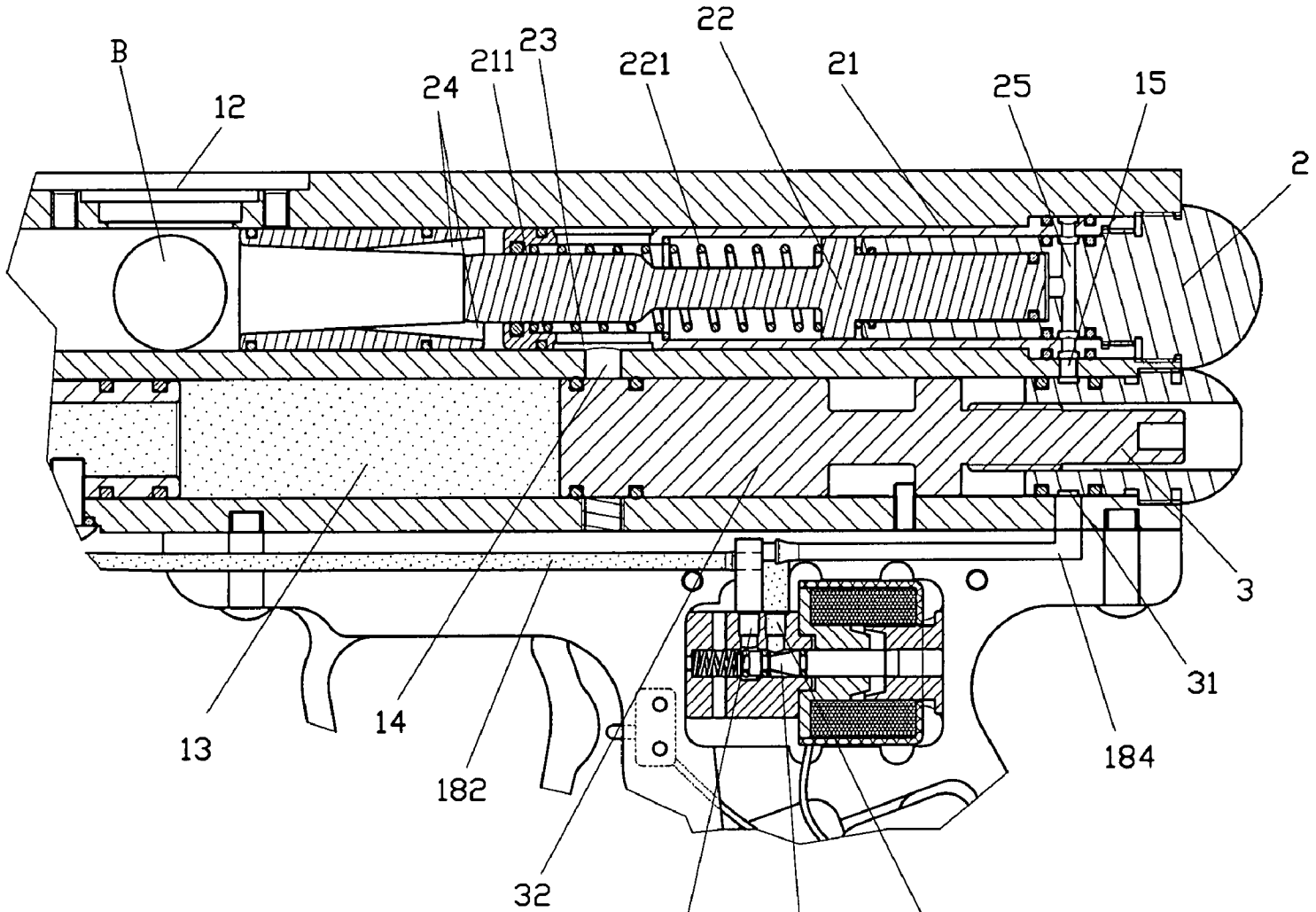
FIG. 5 is a cross-sectional view showing that a low pressure regulator is turned to block a port of an air storage chamber of the preferred embodiment of the present invention.
Figure 6:
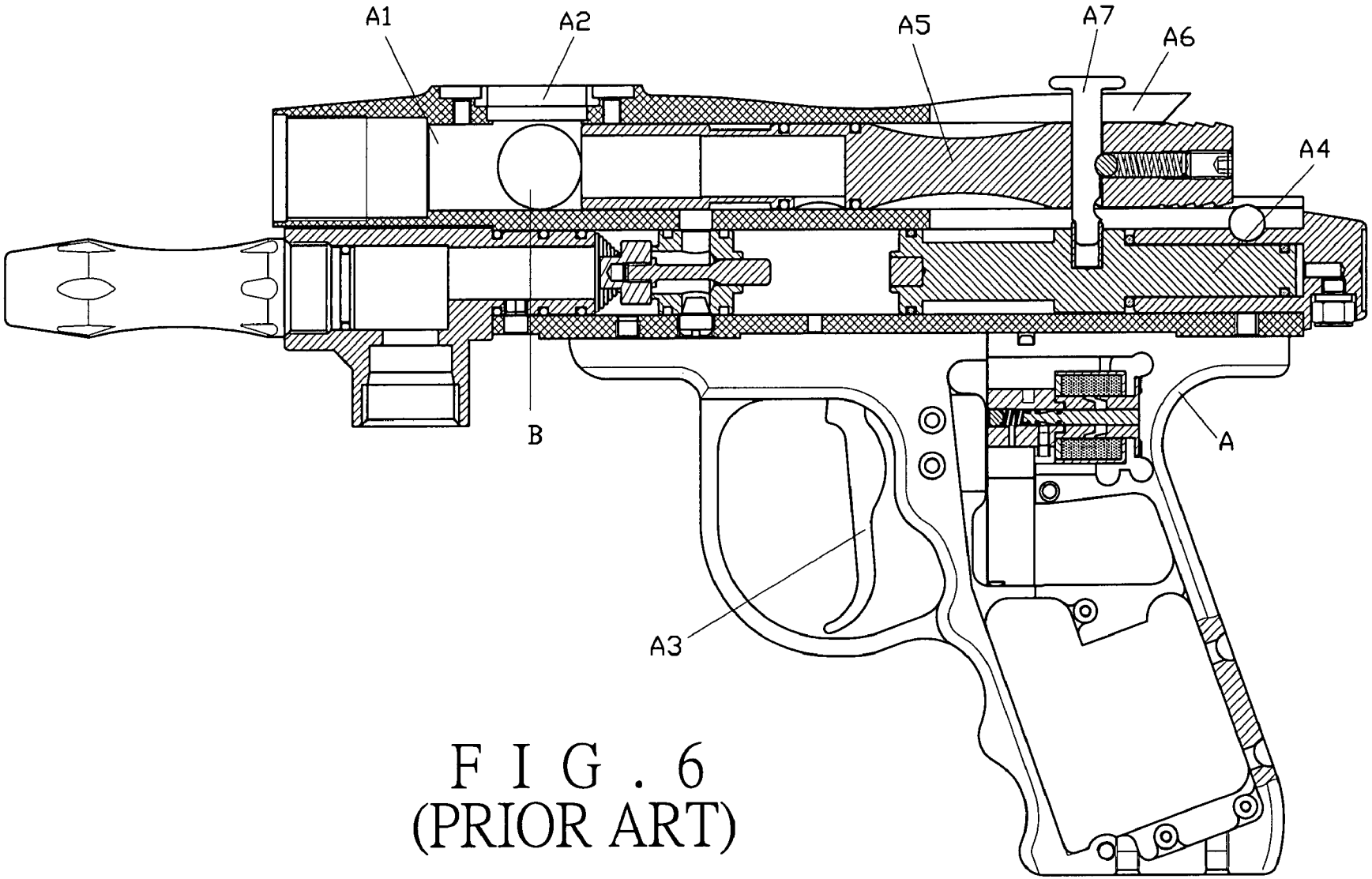
FIG. 6 (PRIOR ART)
FIG. 6 is a cross-sectional view of a striking structure of the prior art.

To avoid triggering accidentally, as shown in FIG. 5, a hand tool (C) may be adapted to turn the low pressure regulator (3), so that the block (32) at the front end of the low pressure regulator (3) may be slid within the air storage chamber (13) till the port (14) is blocked to cut the high pressurized air in the air storage chamber (13) from entering into the barrel (11) and firing the paintball (B).

I claim:

1. A paintball gun comprising a frame, a spool and a low pressure regulator;

said frame comprising a barrel having a paintball drop hole thereon, an air storage chamber being formed underneath said barrel, a port being disposed at a front section between said air storage chamber and said barrel, a key hole being disposed at a rear section between said air storage chamber and said barrel, the frame further comprising a trigger and a three-way valve, said trigger controlling said three-way valve, said three-way valve comprising an air inlet hole interconnecting with an air inlet way, an air outlet hole interconnecting with an air outlet way, and a rod adapted to block the connection of said air inlet hole and said air outlet hole;

the spool disposed in said barrel comprising a sleeve, said sleeve having an opening at a front end of said sleeve, a piston being provided in said sleeve to block said opening of said sleeve, a spring being provided between said piston and said sleeve, a through hole being formed at a front section of said sleeve to penetrate outside, another through hole being formed at a front section of said piston to penetrate outside, said spool further comprising a through channel at a rear section thereof;

the low pressure regulator being threaded into said air storage chamber, a groove being provided on a circumferential portion of said low pressure regulator to interconnect said through channel and said air outlet way, a block being provided at a front end of said low pressure regulator.

* * * * *